US009074484B2

(12) United States Patent
Tibbott et al.

(10) Patent No.: US 9,074,484 B2
(45) Date of Patent: Jul. 7, 2015

(54) COOLED ROTOR BLADE

(75) Inventors: Ian Tibbott, Lichfield (GB); Oliver C T Tibbott, Lichfield (GB)

(73) Assignee: ROLLS-ROYCE PLC, London (GB)

( * ) Notice: Subject to any disclaimer, the term of this patent is extended or adjusted under 35 U.S.C. 154(b) by 657 days.

(21) Appl. No.: 13/207,960

(22) Filed: Aug. 11, 2011

(65) Prior Publication Data

US 2012/0082567 A1 Apr. 5, 2012

(30) Foreign Application Priority Data

Sep. 30, 2010 (GB) ..... 1016423.4

(51) Int. Cl.
*F01D 5/18* (2006.01)
*F01D 5/08* (2006.01)

(52) U.S. Cl.
CPC ..... *F01D 5/186* (2013.01); *F01D 5/081* (2013.01); *F01D 5/187* (2013.01); *F05D 2240/304* (2013.01); *F05D 2240/81* (2013.01); *F05D 2230/12* (2013.01)

(58) Field of Classification Search
CPC ..... F01D 25/08; F01D 25/12; F01D 5/00; F01D 5/08; F01D 5/081; F01D 5/085; F01D 5/087; F01D 5/088; F01D 5/18; F01D 5/186; F01D 5/187
USPC ..... 415/115, 116; 416/90 R, 95, 96 R, 97 R, 416/193 A, 193 R
See application file for complete search history.

(56) References Cited

U.S. PATENT DOCUMENTS 4,017,213 A * 4/1977 Przirembel ..... 416/97 A
5,197,852 A * 3/1993 Walker et al. ..... 415/115

(Continued)

FOREIGN PATENT DOCUMENTS

CA 2 568 692 A1 5/2007
EP 1 013 880 A2 6/2000

(Continued)

OTHER PUBLICATIONS

Search Report issued in British Application No. GB1016423.4 dated Jan. 19, 2011.

(Continued)

*Primary Examiner* — Edward Look
*Assistant Examiner* — Christopher R Legendre
(74) *Attorney, Agent, or Firm* — Oliff PLC

(57) ABSTRACT

A cooled turbine rotor blade for a gas turbine engine is provided. The engine has an annular flow path for conducting working fluid though the engine. The blade has an aerofoil section for extending across the annular flow path. The blade further has a root portion radially inward of the aerofoil section for joining the blade to a rotor disc of the engine. The blade further has a platform between the aerofoil section and the root portion. The platform extends laterally relative to the radial direction of the engine to form an inner boundary of the annular flow path and to provide a rear overhang portion which projects in use towards a corresponding platform of a downstream nozzle guide vane. The platform contains at least one internal elongate plenum chamber for receiving cooling air. The longitudinal axis of the plenum chamber is substantially aligned with the circumferential direction of the engine. The plenum chamber supplies the cooling air to a plurality of exit holes formed in the external surface of the rear overhang portion to cool that portion.

11 Claims, 5 Drawing Sheets

(56) References Cited

U.S. PATENT DOCUMENTS

| | | | | |
|---|---|---|---|---|
| 5,344,283 | A * | 9/1994 | Magowan et al. | 415/115 |
| 5,399,065 | A * | 3/1995 | Kudo et al. | 415/115 |
| 5,813,835 | A * | 9/1998 | Corsmeier et al. | 416/97 R |
| 5,848,876 | A * | 12/1998 | Tomita | 416/96 R |
| 5,997,245 | A * | 12/1999 | Tomita et al. | 415/115 |
| 6,120,249 | A * | 9/2000 | Hultgren et al. | 416/97 R |
| 6,132,173 | A * | 10/2000 | Tomita et al. | 416/96 R |
| 6,210,111 | B1 * | 4/2001 | Liang | 416/97 R |
| 6,241,467 | B1 * | 6/2001 | Zelesky et al. | 415/115 |
| 6,508,620 | B2 | 1/2003 | Sreekanth et al. | |
| 6,887,033 | B1 * | 5/2005 | Phillips et al. | 415/115 |
| 7,198,467 | B2 * | 4/2007 | Keith et al. | 416/96 R |
| 7,309,212 | B2 * | 12/2007 | Itzel et al. | 416/193 A |
| 7,442,008 | B2 * | 10/2008 | Kopmels et al. | 416/97 R |
| 7,534,088 | B1 * | 5/2009 | Alvanos et al. | 416/97 R |
| 8,070,421 | B2 * | 12/2011 | Dalton et al. | 415/115 |
| 8,221,055 | B1 * | 7/2012 | Liang | 415/115 |
| 8,282,354 | B2 * | 10/2012 | Spangler | 416/193 A |
| 8,376,705 | B1 * | 2/2013 | Liang et al. | 416/95 |
| 8,529,194 | B2 * | 9/2013 | Ammann et al. | 415/115 |
| 8,840,370 | B2 * | 9/2014 | Walunj et al. | 416/96 R |
| 8,845,289 | B2 * | 9/2014 | Walunj et al. | 416/96 R |
| 8,870,525 | B2 * | 10/2014 | Walunj et al. | 415/115 |
| 2005/0058545 | A1 * | 3/2005 | Cardenas | 416/97 R |
| 2005/0100437 | A1 | 5/2005 | Phillips et al. | |
| 2009/0202339 | A1 * | 8/2009 | Torii et al. | 415/115 |
| 2009/0246006 | A1 * | 10/2009 | Dalton et al. | 415/173.1 |
| 2009/0263251 | A1 * | 10/2009 | Spangler | 416/223 R |
| 2012/0082567 | A1 * | 4/2012 | Tibbott et al. | 416/97 R |
| 2013/0115101 | A1 * | 5/2013 | Walunj et al. | 416/97 R |
| 2013/0171003 | A1 * | 7/2013 | Ellis et al. | 416/97 R |
| 2014/0154063 | A1 * | 6/2014 | Zhang et al. | 415/177 |
| 2014/0321961 | A1 * | 10/2014 | Beattie et al. | 415/1 |
| 2015/0056073 | A1 * | 2/2015 | Fedor et al. | 416/1 |

FOREIGN PATENT DOCUMENTS

| | | | |
|---|---|---|---|
| EP | 1 384 855 | A2 | 1/2004 |
| EP | 1 074 696 | B1 | 5/2006 |
| EP | 2 037 081 | A1 | 3/2009 |
| EP | 2 110 513 | A2 | 10/2009 |
| JP | A-2000-220404 | | 8/2000 |
| WO | WO 2010/086402 | A2 | 8/2010 |

OTHER PUBLICATIONS

European Search Report issued in European Application No. 11 17 7245 on Jan. 16, 2014.

* cited by examiner

COOLED ROTOR BLADE

The present invention relates to a cooled rotor blade for a gas turbine engine.

The performance of the gas turbine engine cycle, whether measured in terms of efficiency or specific output, is improved by increasing the turbine gas temperature. It is therefore desirable to operate the turbine at the highest possible temperature. For a given engine compression ratio or bypass ratio, increasing the turbine entry gas temperature will produce more specific thrust (e.g. engine thrust per unit of air mass flow).

However, in modern engines, the high pressure (HP) turbine gas temperatures are now much hotter than the melting point of the aerofoil materials, necessitating internal air cooling of the aerofoils. In some engines the intermediate pressure (IP) and low pressure (LP) turbines are also cooled, although during its passage through the turbine the mean temperature of the gas stream decreases as power is extracted.

Internal convection and external films are the prime methods of cooling the aerofoils. HP turbine nozzle guide vanes (NGVs) consume the greatest amount of cooling air on high temperature engines. HP blades typically use about half of the NGV flow. The IP and LP stages downstream of the HP turbine use progressively less cooling air.

FIG. 1 shows an isometric view of a single stage of a conventional cooled turbine. Cooling air flows to and from an NGV 1 and a rotor blade 2 are indicated by arrows. The cooling air cools the NGV and rotor blade internally by convection and then exits the NGV and rotor blade through many small exterior holes 3 to form cooling films over the external aerofoil surfaces. The NGV and rotor blade may be further protected from the hot gas temperatures by thermal barrier coatings (TBCs) formed on these components.

The cooling air is high pressure air from the HP compressor that has by-passed the combustor and is therefore relatively cool compared to the gas temperature in the turbine. Typical cooling air temperatures are between 800° and 1000° K. Gas temperatures can be in excess of 2100° K.

The cooling air from the compressor that is used to cool the hot turbine components is not used fully to extract work from the turbine. Extracting coolant flow therefore has an adverse effect on the engine operating efficiency. It is thus important to use this cooling air as effectively as possible.

FIG. 2 shows a view of the radially inner end of a high temperature HP turbine rotor blade. The blade has an aerofoil section 4, and a platform 7 which forms the inner boundary of the hot gas flow path and from which the aerofoil section extends. The blade also has an under-platform section 5 with a fir tree fixing 5*a* for connecting the blade to a rotor disc 6, a relatively straight-walled shank 5*b* and a recess portion 5*c*. The recess portion 5*c* develops the straight walls of the shank to the shape of the aerofoil surfaces and in so doing forms recesses beneath the platform. Cooling air typically enters the blade at one or more entrances in the fir tree fixing, and travels into feed passages which extend along the aerofoil section. Cooling air for cooling the radially outer edge of the rotor disc enters the under-platform recesses.

A difficult location to cool on a high temperature HP turbine blade is the platform, and especially the rear overhang region 7*a* which projects towards the corresponding platform of the downstream NGV (not shown in FIG. 1). Generally the forward overhang region 7*b* is bathed in cool, dense "blade root seal leakage flow", that migrates around the suction surface of the aerofoil, in the fillet radius, where it joins the platform. Consequently there is little or no need to further cool this region. The mid region 7*c* of the platform often requires cooling, but there is a convenient source of cooling air in the under-platform recesses from which film cooling can be tapped. The aerofoil section feed passages are also relatively accessible. The recesses and/or the passages can be reached by drilling cooling holes exiting on the platform's mid region gas washed surface or from the end faces where neighbouring platforms meet.

The rear overhang region of the platform, on the other hand, is typically the location that is subjected to the highest heatload. This is due to very high external heat transfer coefficients generated in and adjacent to the wake of the aerofoil, combined with hot gas, due to migrating secondary flows from the pressure surface of the aerofoil. Further, this region is difficult to cool.

One option is to rely on a leakage cooling flow (disc rear face leakage air) from a source behind the rear face of the rotor disc, the leakage flow passing under the rear overhang and then escaping to the gas path. However, the heat transfer coefficients generated by this leakage flow passing over the rotating lower surface of the rear overhang region 7*a* may not be adequate to cool effectively the upper gas washed surface of the region, particularly for high temperature applications.

Cooling holes can be drilled from the rear overhang region to the rearmost aerofoil section feed passage, but these holes are difficult and costly to drill and the length of the drilled holes causes the cooling air to be heated substantially by the time it reaches the platform's rear edge, thereby losing much of its cooling potential. In addition, there is little choice in the trajectory which the drilled holes must take, with the result that the cooling air may exit the holes at less than optimum angles relative to the surface of the platform and more importantly relative to the aerofoil mainstream gas exit angle. This results in high mixing losses and poor effectiveness of the cooling film to which the exiting air contributes.

In the absence of effective cooling of the rear overhang region, the TBC formed on the region may shed, which further increases the heatload due to increased surface roughness of the gas-washed surface. The rear overhang region can then overheat and prematurely oxidise. Eventually cracks may be generated in the region, which if allowed to propagate can result in blade failure.

The present invention seeks to address problems with known arrangements for cooling turbine blade platforms.

Thus a first aspect of the invention provides cooled turbine rotor blade for a gas turbine engine which has an annular flow path for conducting working fluid though the engine, wherein the blade has:

an aerofoil section for extending across the annular flow path, a root portion radially inward of the aerofoil section for joining the blade to a rotor disc of the engine, and a platform between the aerofoil section and the root portion, the platform extending laterally relative to the radial direction of the engine to form an inner boundary of the annular flow path and to provide a rear overhang portion which projects in use towards a corresponding platform of a downstream nozzle guide vane;

wherein the platform contains at least one internal elongate plenum chamber for receiving cooling air, the longitudinal axis of the plenum chamber being substantially aligned with the circumferential direction of the engine, and the plenum chamber supplying the cooling air to a plurality of exit holes formed in the external surface of the rear overhang portion to cool that portion.

By providing the elongate plenum chamber, it is possible to shorten the flow distance of the cooling air to the exit holes, which improves the convective cooling effectiveness of the cooling air and also allows the exit holes to be configured to enhance film cooling protection and reduce aerodynamic mixing losses. Indeed, improved cooling of the rear overhang portion can allow longer overhangs to be adopted, which can in turn improve gas path endwall sealing between the blade and the downstream NGV.

Although the longitudinal axis of the plenum chamber is substantially aligned with the circumferential direction of the engine, some variation away from the exact circumferential direction can be tolerated (e.g. up to 10°, but preferably no more than 5° from the circumferential direction), for example to position the chamber more optimally with respect to supplies of cooling air.

Typically, the longitudinal axis of the plenum chamber passes through a position in the platform beneath the trailing edge of the aerofoil section. The platform is typically at or close to its thickest at this position, which provides space for the chamber and can also locate the chamber between convenient sources of cooling air and desirable positions of the exit holes Preferably the plenum chamber is formed by drilling through the platform from one side thereof, for example by electrode discharge machining (EDM). The plenum chamber may be formed by drilling through the platform from opposing sides thereof. The two drillings can then meet to form the chamber. The two drilling approach may be faster and/or more accurate than a single drilling approach. Typically, the or each drilling hole formed at the respective side of the platform is plugged after the drilling procedure, for example by localised welding. A bleed hole to help prevent blockage of the chamber by air-bourn dust may be formed in the or each drilling hole plug.

Preferably, at least some of the exit holes are formed on the radially outer surface of the rear overhang portion. However, drilling holes may also be formed at a rearward edge of the rear overhang portion and for at the radially inner surface of the rear overhang portion.

The blade may further have an elongate internal feed passage for carrying cooling air, the feed passage extending in a radial direction through the platform and along the aerofoil section, and cooling air being diverted to the plenum chamber from the feed passage. Such a feed passage provides a convenient source for the cooling air.

Alternatively, or additionally, the blade may further have an external under-platform recess which receives cooling air, e.g. for cooling the radially outer edge of the rotor disc, the cooling air being diverted to the plenum chamber from the under-platform recess.

Preferably, the plenum chamber has a non-circular (e.g. an elliptical or a racetrack) cross-section. Such a cross-section can be orientated to reduce stress levels in the platform caused by centrifugal loading of the rear overhang portion.

The blade may have two plenum chambers, which typically share the same longitudinal axis, and typically are drilled through the platform from opposing sides thereof (but do not meet).

A second aspect of the invention provides a gas turbine engine having one or more cooled turbine rotor blades according to the previous aspect.

Embodiments of the invention will now be described by way of example with reference to the accompanying drawings in which.

Figure 3A:
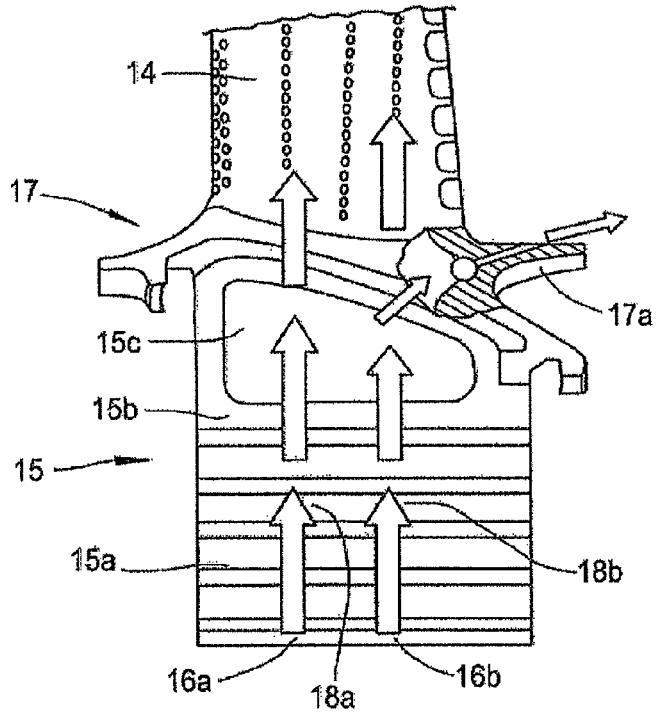
FIG. 3(*a*) shows a schematic pressure surface side view of the radially inner end of a high temperature HP turbine rotor blade, and FIG. 3(*b*) shows a close up view of a cut away section of FIG. 3(*a*)
Figure 3B:
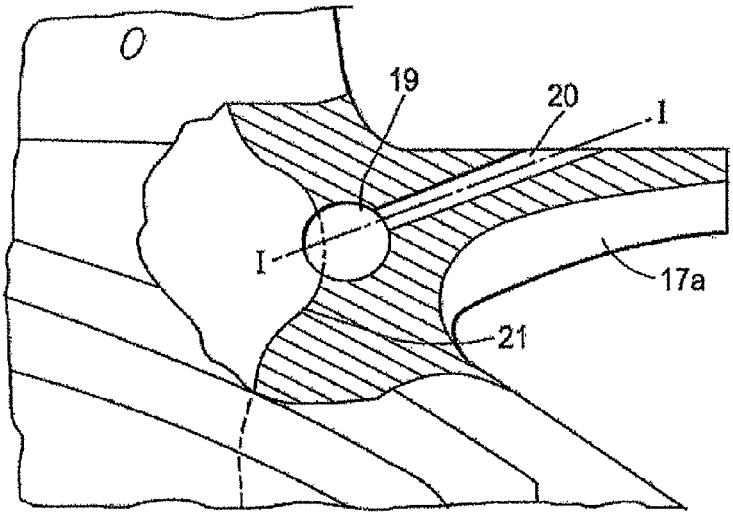
Figure 5A:
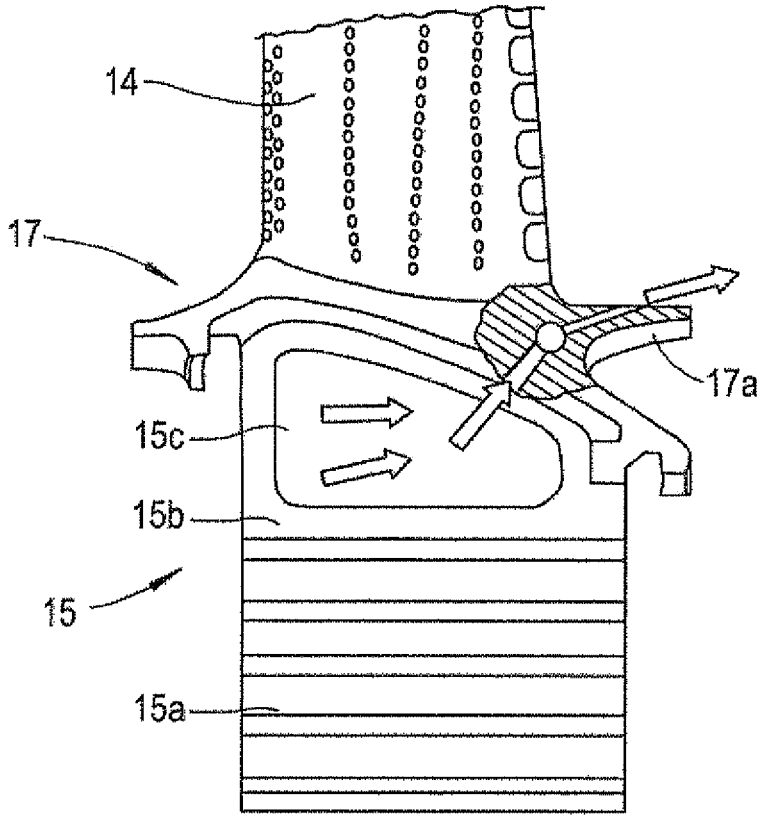
Figure 5B:
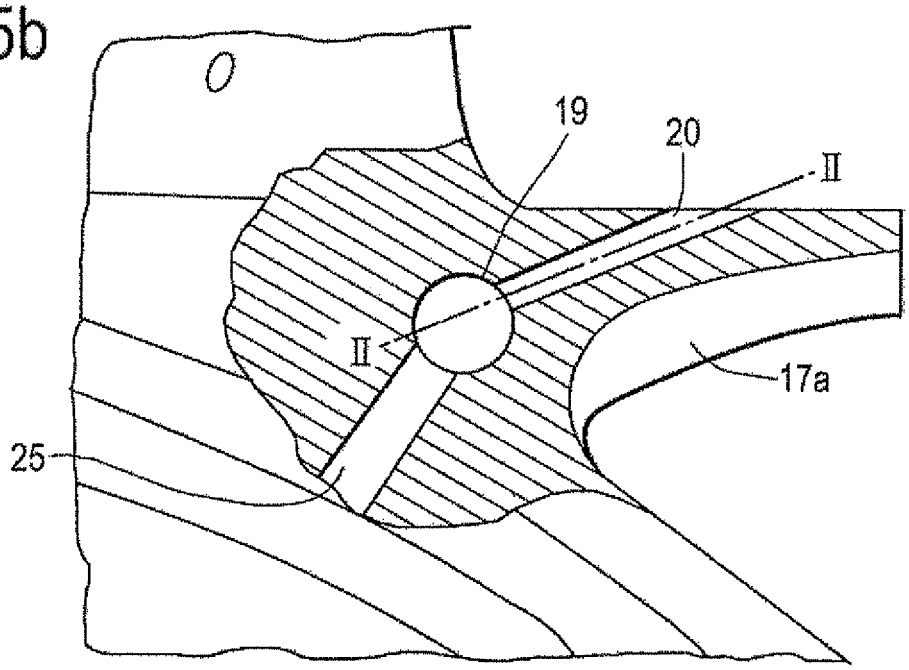
Figure 6:
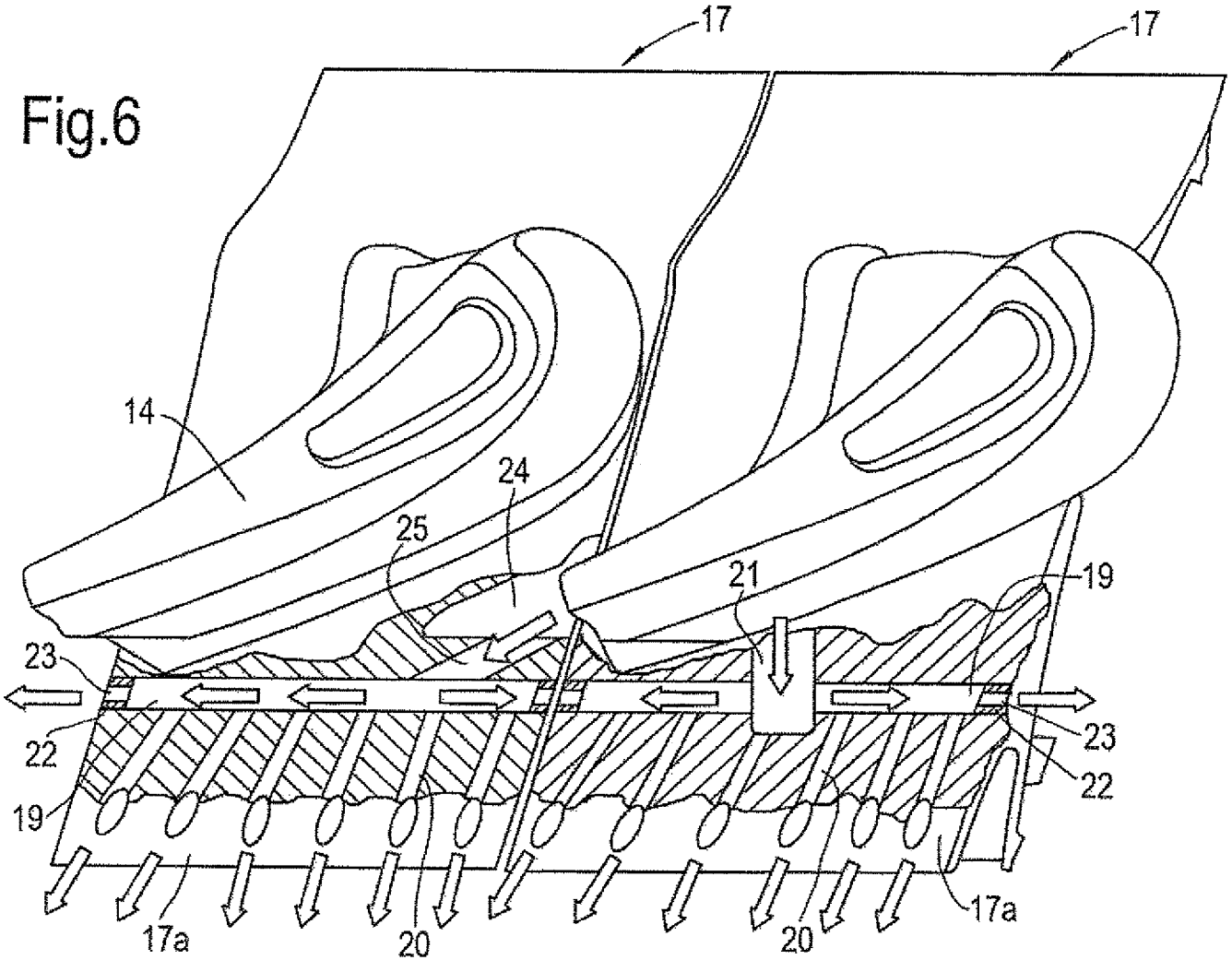

FIG. 5(*a*) shows a schematic pressure surface side view of the radially inner end of a further high temperature HP turbine rotor blade, and FIG. 5(*b*) shows a close up view of a cut away section of FIG. 5(*a*); and FIG. 6 shows a view from the radially outer ends of two adjacent blades, the right hand blade being similar to the blade of FIGS. 3(*a*) and (*b*), and the left hand blade being similar to the blade of FIGS. 5(*a*) and (*b*).

FIG. 3(*a*) shows a schematic pressure surface side view of the radially inner end of a high temperature HP turbine rotor blade. A partially cut away section reveals interior details. FIG. 3(*b*) shows a close up view of the cut away section of FIG. 3(*a*). FIG. 6 shows a view from the radially outer ends of two adjacent blades, the right hand blade being similar to the blade of FIGS. 3(*a*) and (*b*), and having a partially cut away section along the plane marked I-I in FIG. 3(*b*). In FIGS. 3(*a*) and 6, outlined arrows indicate directions of cooling air flow.

The blade has an aerofoil section 14 and a radially inner platform 17 from which the aerofoil section extends. The outer surface of the platform forms the boundary of the annular working fluid flow path through the engine. Radially inwards of the platform, the blade has an under-platform section 15 with a fir tree fixing 15*a*, a relatively straight-walled shank 15*b* and a recess portion 15*c*. The recess portion 15*c* develops the straight walls of the shank to the shape of the aerofoil surfaces and in so doing forms a recess beneath the platform on the pressure side of the blade, and forward and rearward recesses on the suction side of the blade. Cooling air enters the blade at forward 16*a* and rearward 16*b* entrances at the base of the fir tree fixing, and travels into corresponding forward 18*a* and rearward 18*b* feed passages which extend up to and along the aerofoil section. Cooling air for cooling the radially outer edge of the rotor disc enters the under-platform recesses.

The platform 17 has a rear overhang region 17*a*, which projects rearwardly towards the corresponding radially inner platform of a downstream NGV (not shown in FIG. 3). To cool this region, an elongate plenum chamber 19 is drilled, typically by EDM, through the platform in a circumferential direction from one side of the platform to the other, or from both sides of the platform, meeting in the middle. The chamber is located beneath the trailing edge of the aerofoil, at the thickest section of the platform 17, and intersects with the rearward aerofoil feed passage 18*b*, such that the chamber is supplied with cooling air diverted from the passage. The passage (which is typically formed during casting of the blade by a correspondingly-shaped core) can be shaped to have an extension portion 21 which extends towards the chamber to facilitate the intersection. The or each opening formed in the side of the platform by the drilling operation is blocked up by a localised weld or other suitable plugging procedure. Typically a small bleed hole 23 is machined through the plug 22 to keep the plug cool and to prevent blockage of the chamber by airborne dust and dirt.

A series of circumferentially spaced film cooling holes 20 are machined in the upper gaswashed surface 30*a* of the overhang region 17*a* and have corresponding passageways which extend to the plenum chamber 19, to provide film cooling protection along with localised convection cooling. Alternatively, the cooling holes can be configured to exhaust to the lower surface, or through the downstream edge 30*b* of the overhang region. The chamber 19 can be sized as a function of the number of film cooling holes, the quantity of coolant required to pass through these holes and the required flow Mach number in the chamber.

The position of the plenum chamber 19 provides a range of possible exit positions and drilling angles for the cooling holes 20. In particular, the combination of position and angle can be selected to enhance film cooling effectiveness and coverage, with respect to the secondary flow direction on the surface of the overhang region 17*a*. In this way, continuation of the cooling film to the extreme downstream edge of the region can be ensured. Indeed, the cooling arrangement can allow the length of the overhang region to be increased to improve the overlap and hence the gas path sealing between the overhang region and the forward extension of the corresponding downstream NGV platform.

Figure 1:
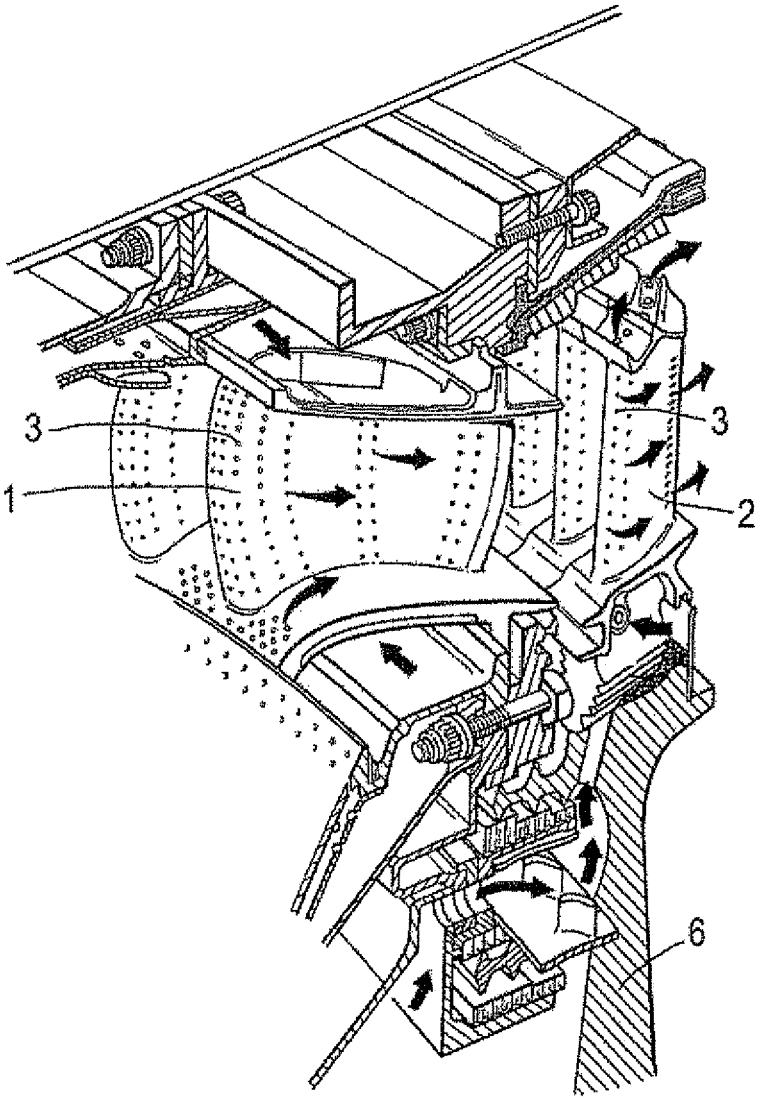
Fig.1 RELATED ART
FIG. 1 shows an isometric view of a single stage of a conventional cooled turbine.
Figure 2:
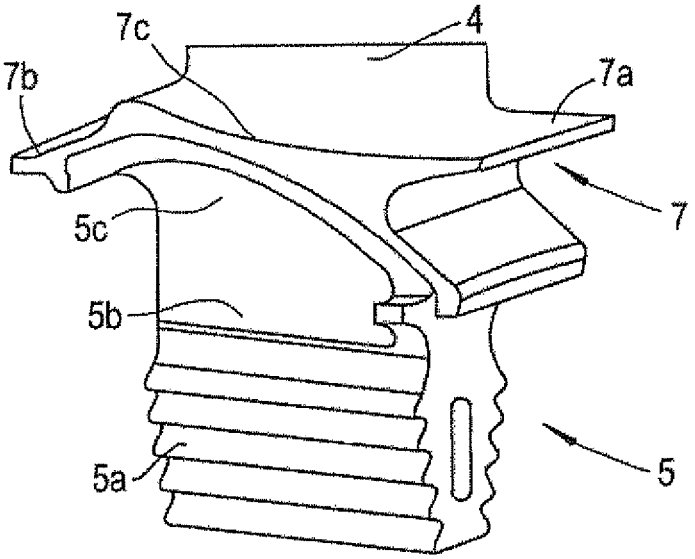
Fig.2 RELATED ART
FIG. 2 shows a view of the radially inner end of a high temperature HP turbine rotor blade.
Figure 4:
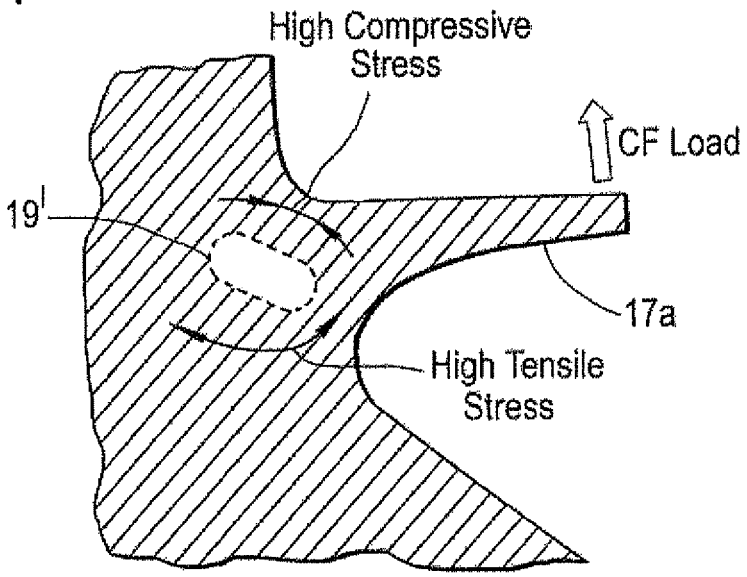
FIG. 4 shows a schematic diagram of forces acting on the rear overhang region of the radially inner platform of a high temperature HP turbine rotor blade.

As shown schematically in FIG. 4, in operation, the rear overhang region 17*a* is subject to high centrifugal (CF) loading. This produces a large bending moment at the part of the region where it merges with the mid region of the platform 17 adjacent the trailing edge of the blade. In particular, high compressive stresses are generated in radially outer positions of this part of the region, and high tensile stresses are generated in radially inner positions. As the plenum chamber 19 also typically extends through this part of the region, it is important to configure the chamber in such a way that dangerous stress concentrations are not generated.

One option is to position the axis of the chamber between the upper and lower surfaces of the overhang region so that the chamber occupies a position which, in the absence of the chamber, would have low principle stress levels. That is, travelling from the outer surface to the inner surface of the rear overhang region, the bending moment stresses vary from high and negative (i.e. compressive), to zero, to high and positive (i.e. tensile). If the chamber axis is located where the stresses would anyway be at or close to zero then the provision of the chamber does not have to lead to dangerously increased stress levels in the surrounding platform. Indeed, the cross-sectional shape of the chamber can be adapted to avoid problematic increases in stress levels. For example, instead of a circular cross-section, the chamber can have a racetrack or elliptical cross-section 19' to maintain a total cross-sectional area but avoid positions with high stresses.

Instead of one plenum chamber 19, two separate elongate plenum chambers could be drilled from opposite sides of the platform 17, the two chambers not meeting at the centre. This could simplify manufacture, but each chamber would then have to have an independent supply of cooling air.

The chamber 19, although still extending in mainly a circumferential direction, could be angled relative to that direction in order to intersect with the rearward aerofoil feed passage 18*b*, thereby avoiding the need for a core extension to form the extension portion 21.

Further cooling holes 20 can be drilled from the sides of the platform 17 (i.e. where neighbouring platforms meet) to the plenum chamber 19. The cooling holes can be fan- or slot-shaped at their exits, rather than circular. Cooling holes can also be drilled to intersect with other cooling holes.

FIG. 5(*a*) shows a schematic pressure surface side view of the radially inner end of a further high temperature HP turbine rotor blade. A partially cut away section reveals interior details. FIG. 5(*b*) shows a close up view of the cut away section of FIG. 5(*a*). In FIG. 6, the left hand blade is similar to the blade of FIGS. 5(*a*) and (*b*) and has a partially cut away section along the plane marked II-II in FIG. 5(*b*). In FIGS. 5(*a*), outlined arrows indicate directions of cooling air flow. Similar features have the same reference numbers in the blades of both FIGS. 3(*a*) and (*b*) and FIGS. 5(*a*) and (*b*).

In the further blade, the cooling air comes from the reservoir of air trapped in the rearward under-platform recess or pocket 24 on the suction side of the blade. A portion of this air is diverted to the plenum chamber 19 via a connecting passage 25 drilled from the rear wall of the pocket to reach the chamber. Optionally, a second connecting passage to the chamber could be drilled from the under-platform pocket on the pressure side of the blade.

Advantages of the cooling arrangement for the rear overhang region are that:

- Shorter cooling holes improve the convective cooling.
- Allows the film cooling holes to be drilled at optimum angles to enhance film cooling protection and reduce aerodynamic mixing losses.
- Cooling holes can be drilled to emerge above, below or at the downstream edge of the region.
- All locations of the region can be reached and adequately cooled by a combination of convective and film cooling.
- Improved cooling allows longer overhangs to be adopted, which can in turn improve gas path endwall sealing between the blade and downstream NGV.
- Lower metal temperatures in the region will increase TBC and oxidation life and lower thermal fatigue cracking and crack propagation rates.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A cooled turbine rotor blade, for a gas turbine engine which has an annular flow path for conducting working fluid though the engine, wherein the blade comprises:

an aerofoil section for extending across the annular flow path, a root portion radially inward of the aerofoil section for joining the blade to a rotor disc of the engine, the root portion comprising a recess portion; and a platform between the aerofoil section and the root portion and that is radially outward of the recess portion, the platform extending laterally relative to a radial direction of the engine to form an inner boundary of the annular flow path and to provide a rear overhang portion which projects rearwardly;

wherein the platform contains at least one internal elongate plenum chamber for receiving cooling air, the longitudinal axis of the plenum chamber being substantially aligned with the circumferential direction of the engine, wherein the longitudinal axis of the plenum chamber is a longest dimension of the plenum chamber, the plenum chamber supplying the cooling air to a plurality of exit holes formed in an external surface of the rear overhang portion to cool that portion, wherein the exit holes communicate with the annular flow path, and the plenum chamber is located radially inward of a trailing edge of the rear overhang portion, and wherein the longitudinal axis of the plenum chamber passes through a position in the platform radially aligned with the trailing edge of the aerofoil section.

2. The cooled turbine rotor blade according to claim 1, wherein the platform comprises a plug at respective circumferential ends of the plenum chamber.

3. The cooled turbine rotor blade according to claim 2 wherein a bleed hole is formed in the or each plug.

4. The cooled turbine rotor blade according to claim 1, wherein at least some of the exit holes are formed on the radially outer surface of the rear overhang portion.

5. The cooled turbine rotor blade according to claim 1, wherein the blade further has an external under-platform recess, cooling air being diverted from the under-platform recess to the plenum chamber.

6. The cooled turbine rotor blade according to claim 1, wherein the plenum chamber has a non-circular cross-section.

7. The cooled turbine rotor blade according to claim 1 having two plenum chambers.

8. The cooled turbine rotor blade according to claim 7, wherein the plenum chambers share the same longitudinal axis.

9. The cooled turbine rotor blade according to claim 7, wherein the plenum chambers define holes through opposing sides of the platform.

10. A gas turbine engine having one or more cooled turbine rotor blades according to claim 1.

11. The cooled turbine rotor blade according to claim 1, wherein the plenum chamber is located at a position where stresses generated by centrifugal loading of the rear overhang portion in use are neutral.

* * * * *